US009015874B2

(12) United States Patent
Slater et al.

(10) Patent No.: US 9,015,874 B2
(45) Date of Patent: Apr. 28, 2015

(54) FOLDABLE HOT TUB SEAT

(75) Inventors: Thomas Arthur Slater, Greenville, SC (US); Adam J. Tavin, East Palo Alto, CA (US); Michael B. Tavin, Boynton Beach, FL (US)

(73) Assignee: Snorkel Hot Tubs, Inc., Seattle, WA (US)

( * ) Notice: Subject to any disclaimer, the term of this patent is extended or adjusted under 35 U.S.C. 154(b) by 714 days.

(21) Appl. No.: 13/370,221

(22) Filed: Feb. 9, 2012

(65) Prior Publication Data

US 2013/0205492 A1 Aug. 15, 2013

(51) Int. Cl.
*A47K 3/022* (2006.01)
*A61H 33/00* (2006.01)

(52) U.S. Cl.
CPC ..... *A61H 33/00* (2013.01); *A61H 2201/0126* (2013.01); *A61H 2201/0161* (2013.01); *A61H 2201/0192* (2013.01); *A61H 2201/1633* (2013.01)

(58) Field of Classification Search
CPC ..... A47K 3/122; A47K 3/12
USPC ..... 4/578.1, 579, 496; 297/14, 335, 336
See application file for complete search history.

(56) References Cited

U.S. PATENT DOCUMENTS

| | | | | |
|---|---|---|---|---|
| 1,059,505 | A | 4/1913 | Tuttle | |
| 1,245,660 | A * | 11/1917 | Behm | 4/579 |
| 2,902,699 | A | 9/1959 | Miller | |
| 3,405,972 | A | 10/1968 | Morris | |
| 4,837,869 | A | 6/1989 | Simmon | |
| 4,893,363 | A | 1/1990 | Huff | |
| 5,185,892 | A | 2/1993 | Mitchell | |
| 5,307,527 | A | 5/1994 | Schober | |
| 5,367,724 | A | 11/1994 | Coccagna | |
| 5,427,435 | A | 6/1995 | Yoder, Jr. | |
| 5,678,890 | A | 10/1997 | Tenbroeck | |
| 5,950,256 | A | 9/1999 | Slater | |
| 6,637,045 | B1 * | 10/2003 | Larsen | 4/496 |
| 6,675,725 | B2 * | 1/2004 | Felton et al. | 108/107 |

* cited by examiner

*Primary Examiner* — Huyen Le
(74) *Attorney, Agent, or Firm* — Davis Wright Tremaine LLP; George C. Rondeau, Jr.

(57) ABSTRACT

A selectively removable and foldable hot tub seat system that is movable to provide additional free area with the hot tub such as when aquatic exercise is desired in the hot tub, and yet can be readily returned into position for seating when a more relaxing use of the hot tub is desired. The foldable hot tub seat system also includes a seat that has an adjustable height, allowing for use by users of differing heights and/or seat height preferences. The hot tub seat system does not require any mounting hardware and may be installed, removed, and adjusted without requiring any tools.

23 Claims, 14 Drawing Sheets

FOLDABLE HOT TUB SEAT

FIELD OF THE INVENTION

The present invention relates generally to hot tub seats, and more particularly, to selectively removable and foldable hot tub seats.

BACKGROUND OF THE INVENTION

The following description includes information that may be useful in understanding the present invention. It is not an admission that any of the information provided herein is prior art or relevant to the presently claimed invention.

For many years, people have used bodies of water for recreational and therapeutic uses. More recently, manufactured "bodies of water" have included hot tubs generally made out of wood staves and generally circular in shape, fiberglass, and acrylic spas of various shapes, and in-ground and aboveground pools. For purposes of this application, "hot tub" includes fiberglass and acrylic spas, hot tubs traditionally made from wood staves, and other spas, tubs and pools for holding water and people.

In addition to the benefits and enjoyment of sitting in a hot tub filled with heated water, some hot tubs are used for exercise. As part of the therapeutic use of these bodies of water, people have adapted them for various forms of exercise, which includes running in place and other aerobic exercises. The increased drag provided by the water serves to make these forms of exercise quite effective while the buoyancy of the water reduces the amount of impact, making aquatic exercise safer than some other forms of exercise.

Acrylic and fiberglass spas generally have molded seats that are immovable. Thus, these forms of hot tubs are not readily conducive to the exercise mentioned since the immovable seats may take up a large area of the hot tub. This is true even when not being used for exercise. In addition, molded seats provide no adjustment for the size of the person using the seat or how deep the person wishes to sit in the water. Other hot tubs have no seats and allow for the exercise mentioned. However, the lack of seats limits the use of the hot tub to exercise and does not permit the user to assume a seated position when relaxing.

BRIEF DESCRIPTION OF THE DRAWINGS

Exemplary embodiments are illustrated in the referenced figures. It is intended that the embodiments and figures disclosed herein are to be considered illustrative rather than restrictive.

DETAILED DESCRIPTION OF THE INVENTION

One skilled in the art will recognize many methods, systems, and materials similar or equivalent to those described herein, which could be used in the practice of the present invention. Indeed, the present invention is in no way limited to the methods, systems, and materials described.

Embodiments of the present invention relate to systems and methods for providing a selectively removable foldable hot tub seat system that is movable to provide additional area when aquatic exercise or simply more free space is desired in the hot tub, and yet can be readily returned into position for seating when a more relaxing use of the hot tub is desired. The foldable hot tub seat system also includes a seat that has an adjustable height, allowing for use by users of different heights and/or seat height preferences.

Figure 1A:
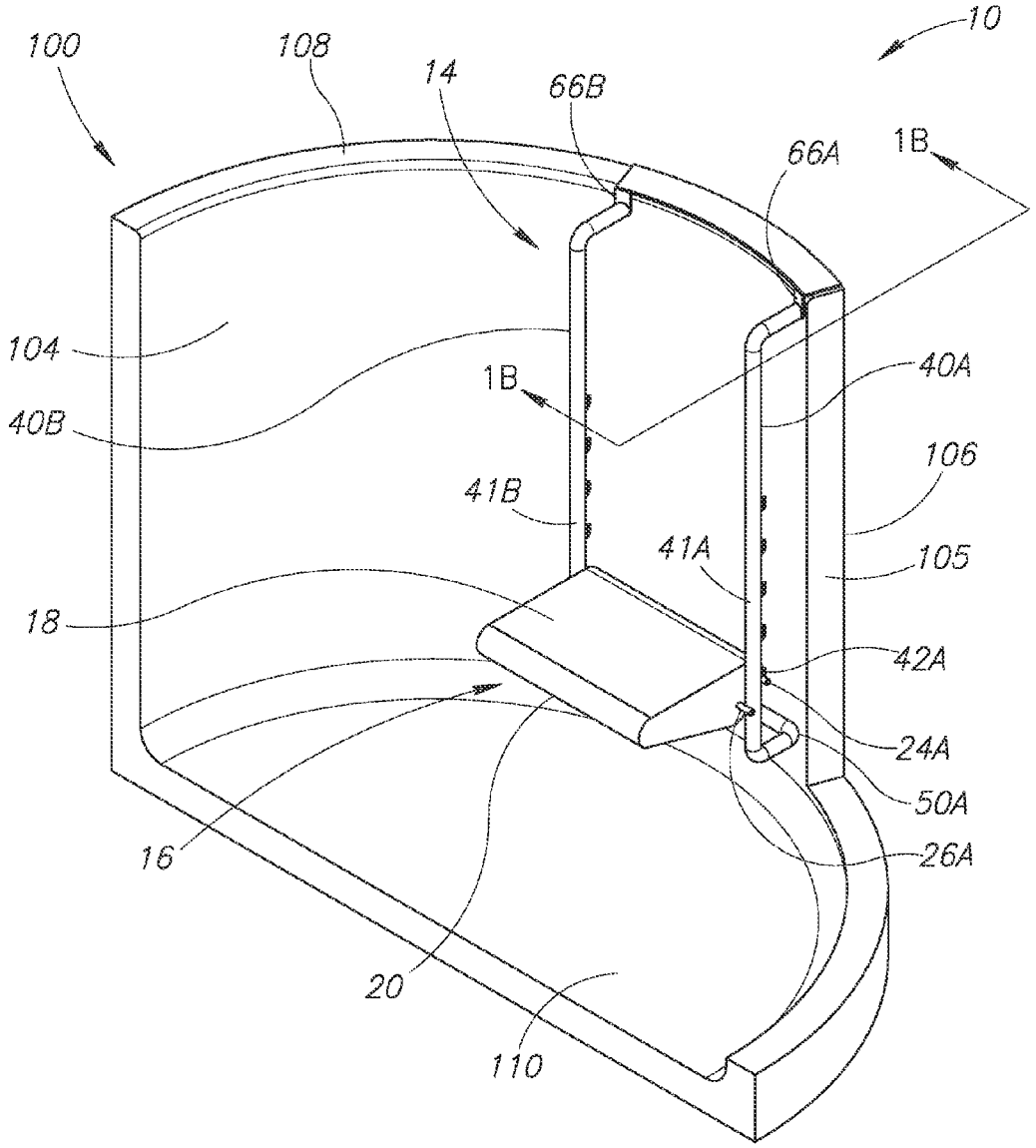
FIG. 1A is a perspective view of a foldable seat system in accordance with an embodiment of the present invention releasably coupled to a hot tub shown when the seat is disposed in a fully down and unfolded position.
Figure 1B:
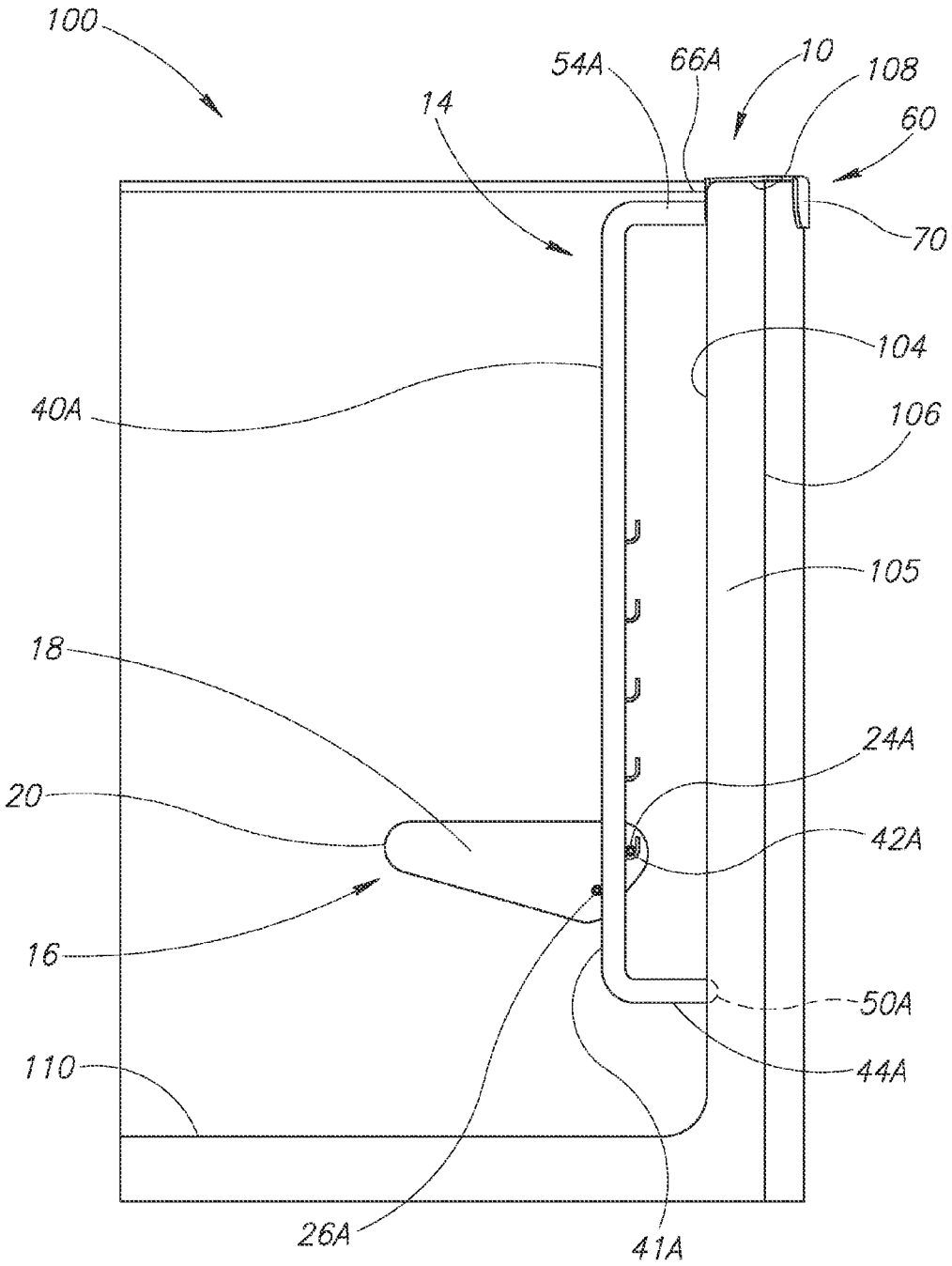
FIG. 1B is a right side elevational view of the foldable seat system and hot tub of FIG. 1A taken substantially along the line 1B-1B of FIG. 1A.
Figure 1C:
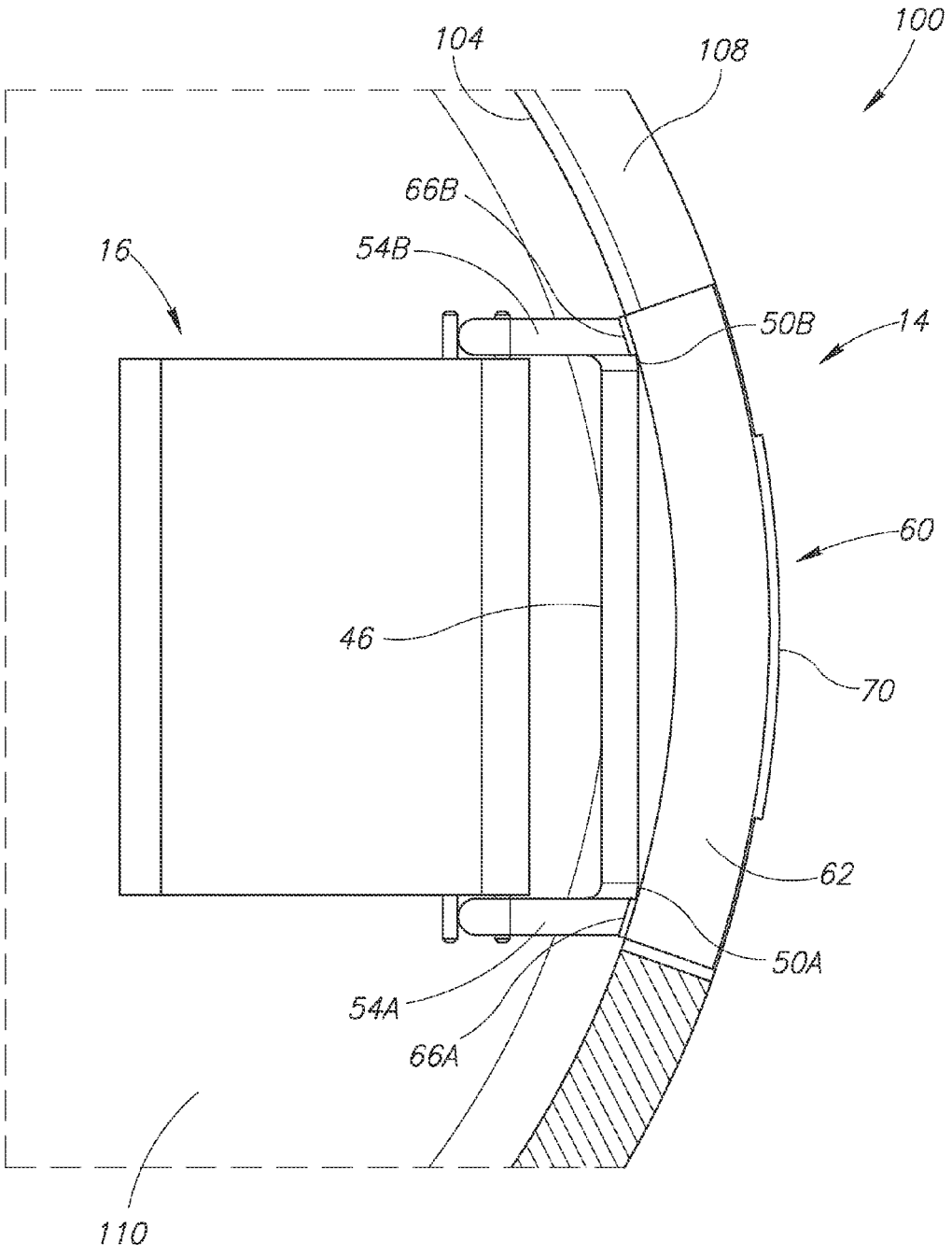
FIG. 1C is an enlarged top view of the foldable seat system and hot tub of FIG. 1A.
Figure 5:
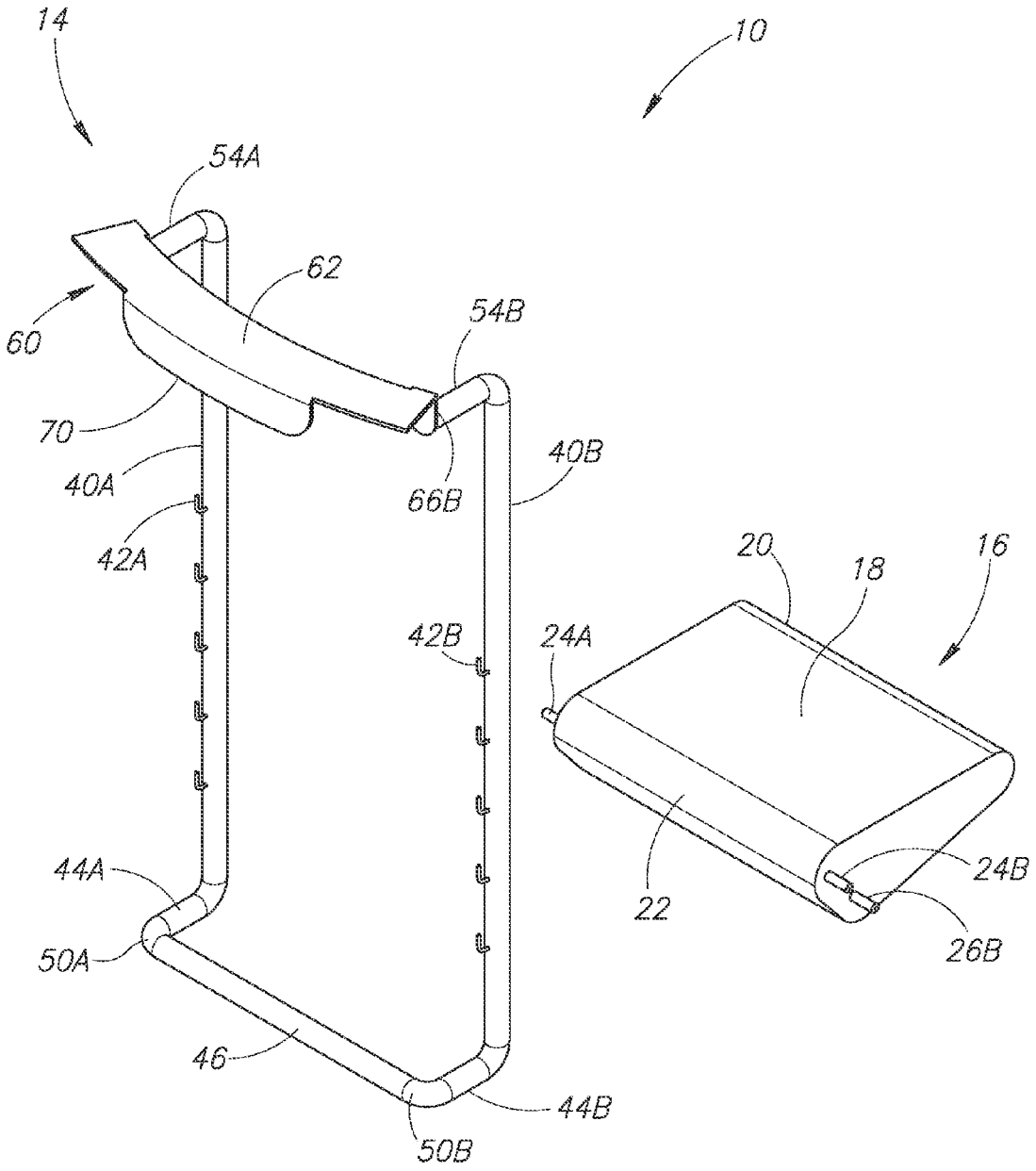
FIG. 5 is an exploded perspective view of the foldable seat system of FIG. 1A.

Referring to FIGS. 1A-1C, a foldable seat system 10 is shown when the system is releasably coupled to a hot tub 100, which is shown partially cut away for illustrative purposes. In these figures, a seat portion 16 (or "seat") of the system 10 is disposed in a deployed or fully down position to allow a user to sit on a main body portion 18 of the seat. FIG. 5 is an exploded perspective view of the foldable seat system 10 that illustrates the various components and portions of the system. The hot tub 100 is generally cylindrical in shape and comprises a bottom surface 110 and an upwardly extending sidewall 105 having an inside surface 104, an outside surface 106, and a top edge or surface 108.

Referring to FIGS. 1A-1C and 5, the seat system 10 includes a seat frame portion 14 configured to reliably couple the system to the hot tub 100 and to support the seat portion 16. The frame portion 14 includes a right vertical bar 40A spaced apart from a left vertical bar 40B. The vertical bars 40A and 40B are coupled to a lower horizontal crossbar 46 via right and left rearward-extending sections 44A and 44B, respectively, forming respective rearward contact surfaces 50A and 5B. The contact surfaces 50A and 50B are positioned to engage the inside surface 104 of the curved sidewall 105 to the hot tub 100 when the frame portion 14 is positioned on the hot tub.

The frame portion 14 also includes a hanger portion 60 that allows it to be removably coupled to or "hang" from the top edge 108 of the sidewall 105 of the hot tub 100. The hanger portion 60 comprises a top plate 62, a frame retaining member or portion 70, and right and left frame coupling portions 66A and 66B, respectively, that are coupled to the vertical bars 40A and 40B by respective upper horizontal bars 54A and 54B. As shown in FIG. 1C, the top plate 62 is arcuate-shaped and sized to complement the curvature of a portion of the top edge 108 of the sidewall 105 and rest thereon. The frame retaining member 70 extends vertically downward from a rear edge of the top plate 62 and is contoured to be disposed adjacent an upper portion of the outside surface 106 of the sidewall 105.

The vertical bars 40A and 40B each include a plurality of rearwardly projecting hooks 42A and 42B, respectively, configured to support the seat portion 16. Each of the hooks 42A and 42B has a horizontally extending portion with one end attached to one of the vertical bars and another end attached to one end of a vertically extending portion. The seat portion 16 comprises a right support pin or rod 24A and a left support pin or rod 24B, each extending laterally outward from the right and left sides, respectively, of the seat body 18 from a back portion 22 thereof and configured to rest on a corresponding one of the plurality of right and left hooks 42A and 42B, respectively.

The seat portion 16 also includes a right stop pin or rod 26A and a left stop pin or rod 26B, each extending laterally outward from the right and left sides, respectively, of the seat body 18 from the back portion 22. The stop rods 26A and 26B are disposed on the body 18 at a position below and forward of the correspondingly positioned one of the pivot rods 24A and 24B (i.e., more toward a front portion 20 of the body 18 than the pivot rods). When the seat body 18 is in the fully down position (see FIGS. 1A-1C), its center of mass is located forward the pivot rods 24A and 24B, which tends to urge the forward portion 20 to rotate in a downward direction. The stop rods 26A and 26B are configured to limit the downward rotation of the seat body 18 by engaging a front surface 41A and 41B (see FIGS. 1A and 1B), respectively, of respective vertical bars 40A and 40B at a location below the support rods 24A and 24B to maintain the seat 16 in the folded down position.

Figure 2:
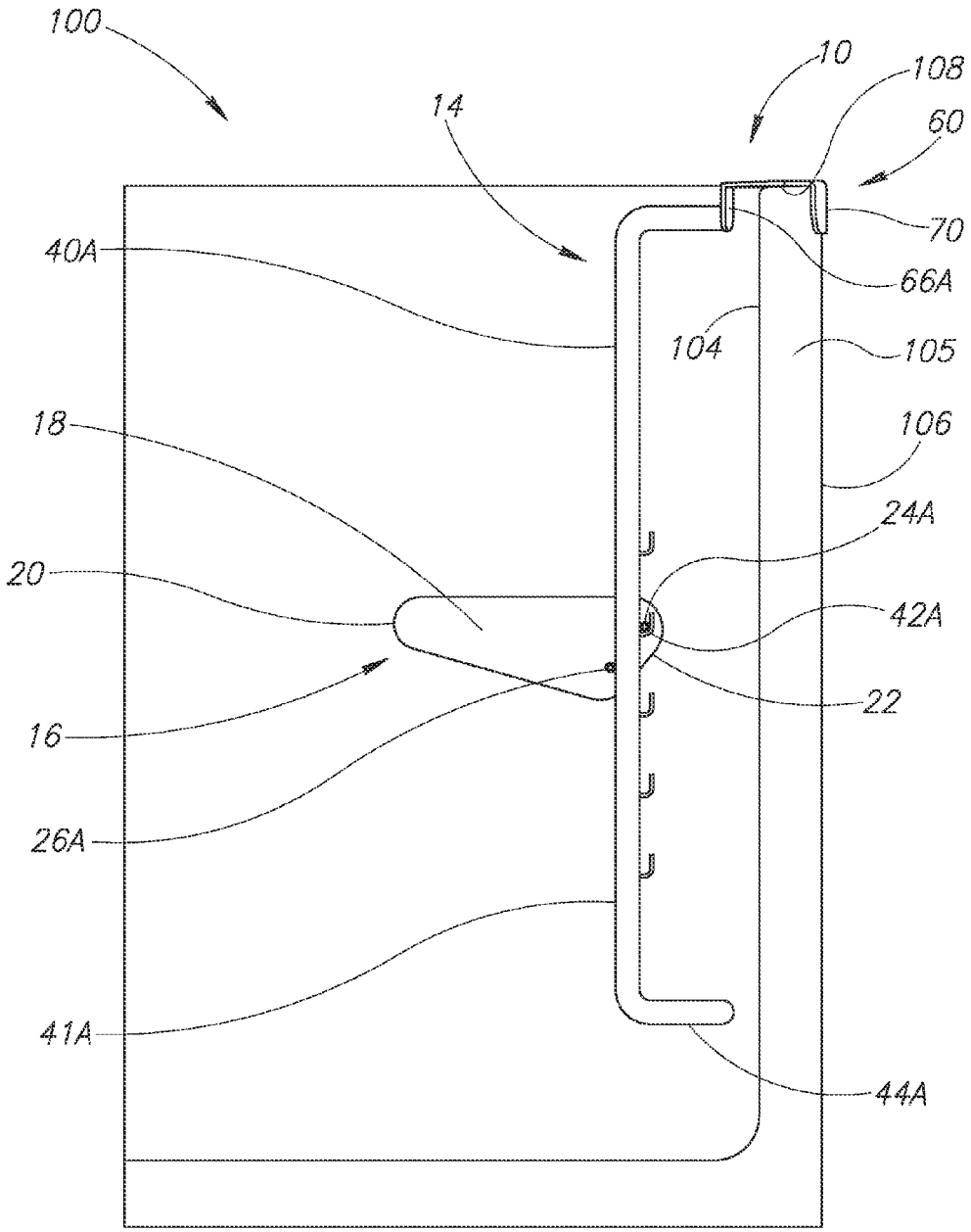
FIG. 2 is a right side elevational view of the foldable seat system and hot tub shown when the seat height is in a raised and unfolded position.

In FIG. 1B, the right support rod 24A is shown resting on the lowest hook 42A of five hooks disposed the vertical bar 40A. Similarly, the left support rod 24B would be resting on the lowest hook 42B of the five hooks disposed on the vertical bar 40B. The weight of the seat portion 16 and a person sitting on the seat body 18 is primarily supported against downward movement along the vertical bars 40A and 40B by the right and left support rods 24A and 24B engaging the horizontally extending portions of right and left hooks 42A and 42B in which they are resting. The vertically extending portion of the right and left hooks 42A and 42B limit rearward movement of the right and left support rods 24A and 24B. In FIG. 2, the right support rod 24A is shown resting on the hook 42A that is the second hook from the top of the five hooks. In this regard, a user may easily adjust the height of the seat portion 16 simply by resting the support rods 24A and 24B on different pairs of hooks 42A and 42B, respectively, located at corresponding locations along the vertical bars 40A and 40B.

Figure 3A:
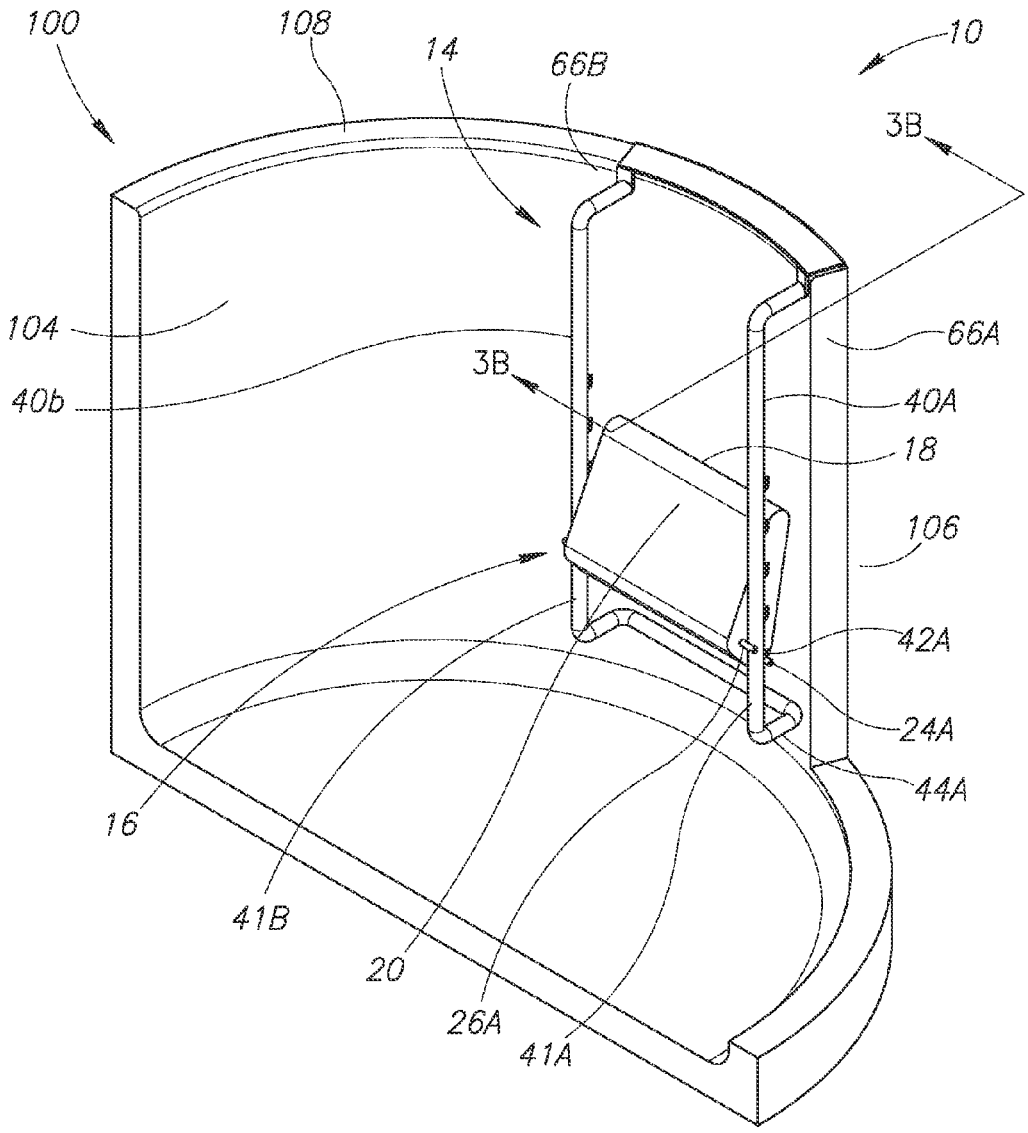
FIG. 3A is a perspective view of the foldable seat system and the hot tub shown when the seat is disposed in an upright or folded up position.
Figure 3B:
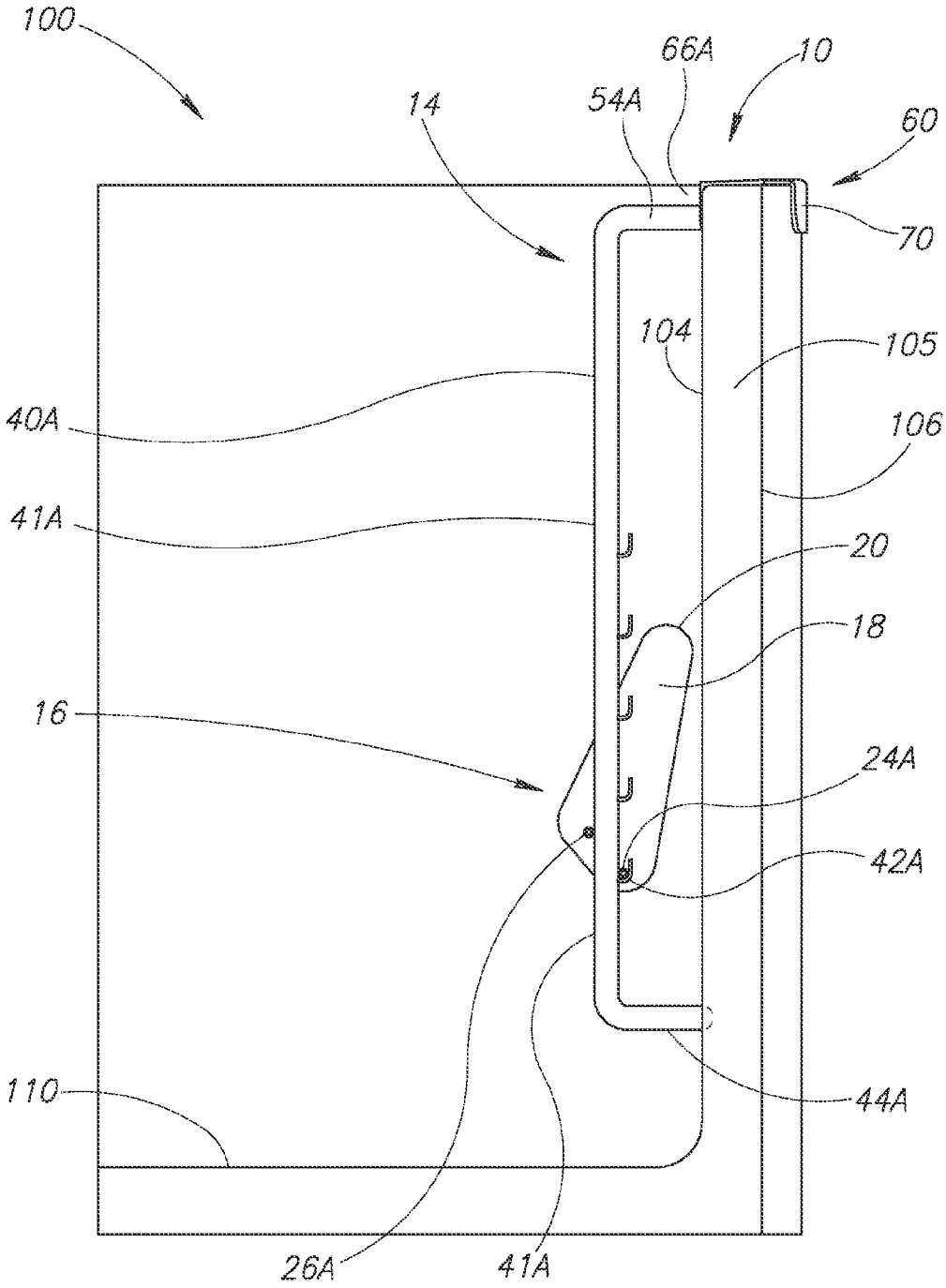
FIG. 3B is a right side elevational view of the foldable seat system and hot tub of FIG. 3A taken substantially along the line 3B-3B of FIG. 3A.

FIGS. 3A and 3B illustrate the seat system 10 when the seat portion 16 is in the fully folded up position so as to be in close proximity to the inside surface 104 of the sidewall 105. As shown, in this position, the stop rods 26A and 26B again engage the front surface 41A and 41B, respectively, but at a location above the support rods 24A and 24B to maintain the seat 16 in the folded up position. The seat body 18 is shaped and weighted such that its center of mass when in the folded up position is behind (to the right in FIG. 3B) the support rods 24A and 24B, such that the front portion 20 of the seat is urged to rotate back toward the sidewall 105 of the hot tub 100. Thus, the stop rods 26A and 26B operate to limit the rearward rotation of the seat 16 and maintain it in the folded up position shown in FIGS. 3A and 3B. When the seat portion 16 is in the folded up position, the user may use the remaining space in the hot tub 100 for other activities such as exercise or to simply accommodate more people in the hot tub. The operation of moving the seat 16 between the fully down position and the folded up position is shown in FIGS. 4A-4C and described below.

Figure 4A:
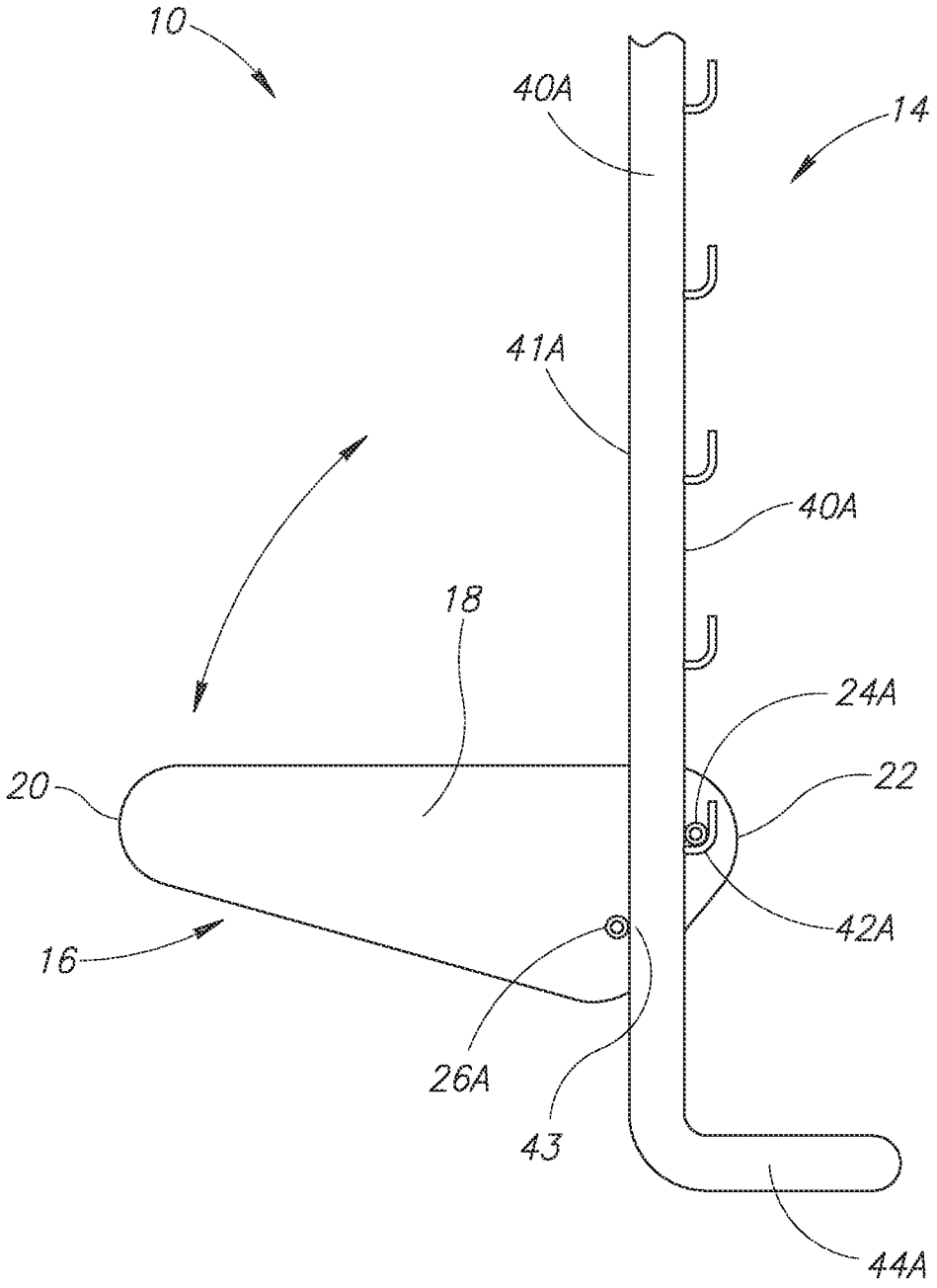
FIG. 4A is an enlarged right side elevational view of the foldable seat system shown when the seat is in the fully down and unfolded position.
Figure 4B:
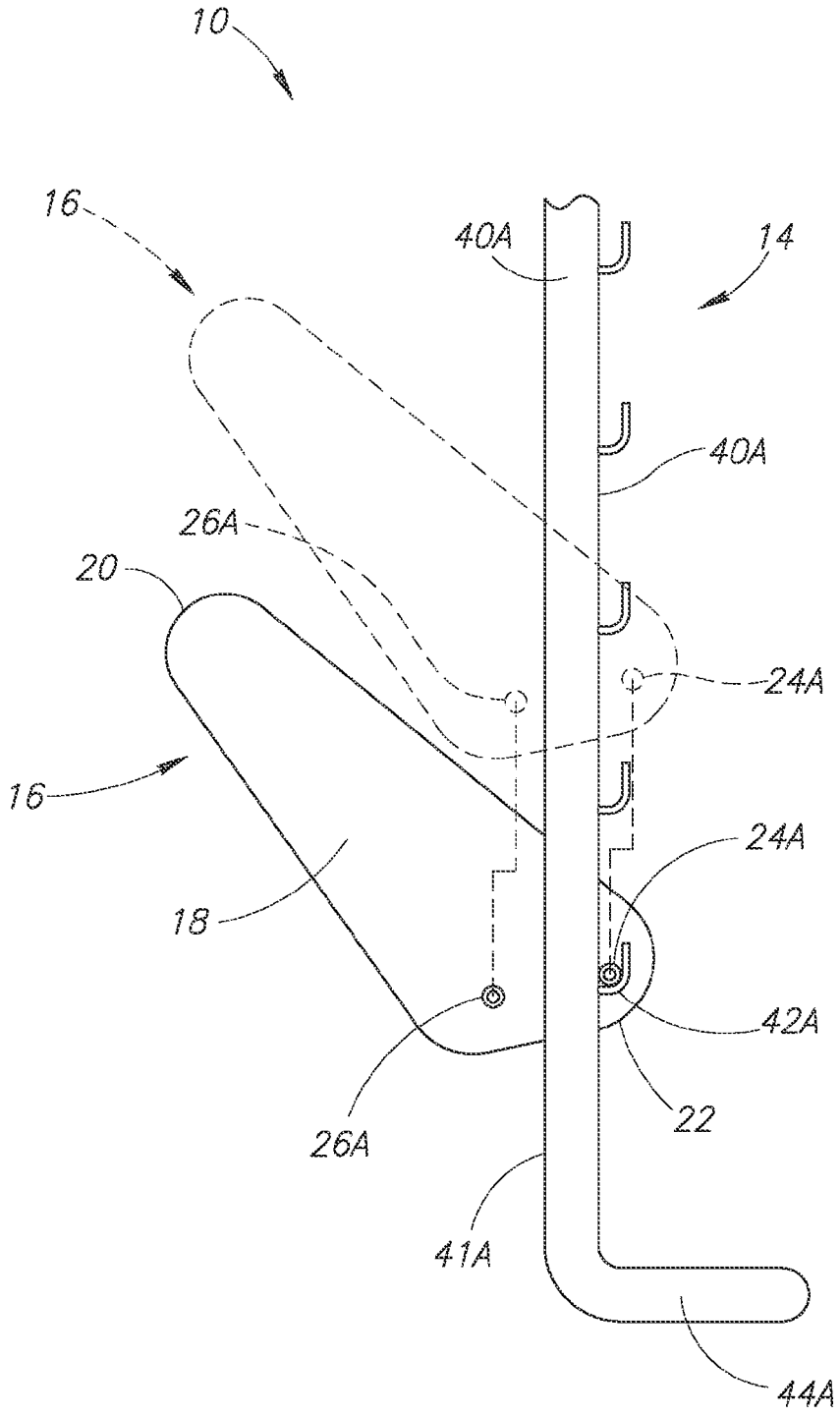
FIG. 4B is an enlarged right side elevational view of the foldable seat system shown when the seat is disposed in a midway position and partially folded up, and illustrative removal of the seat for repositioning.
Figure 4C:
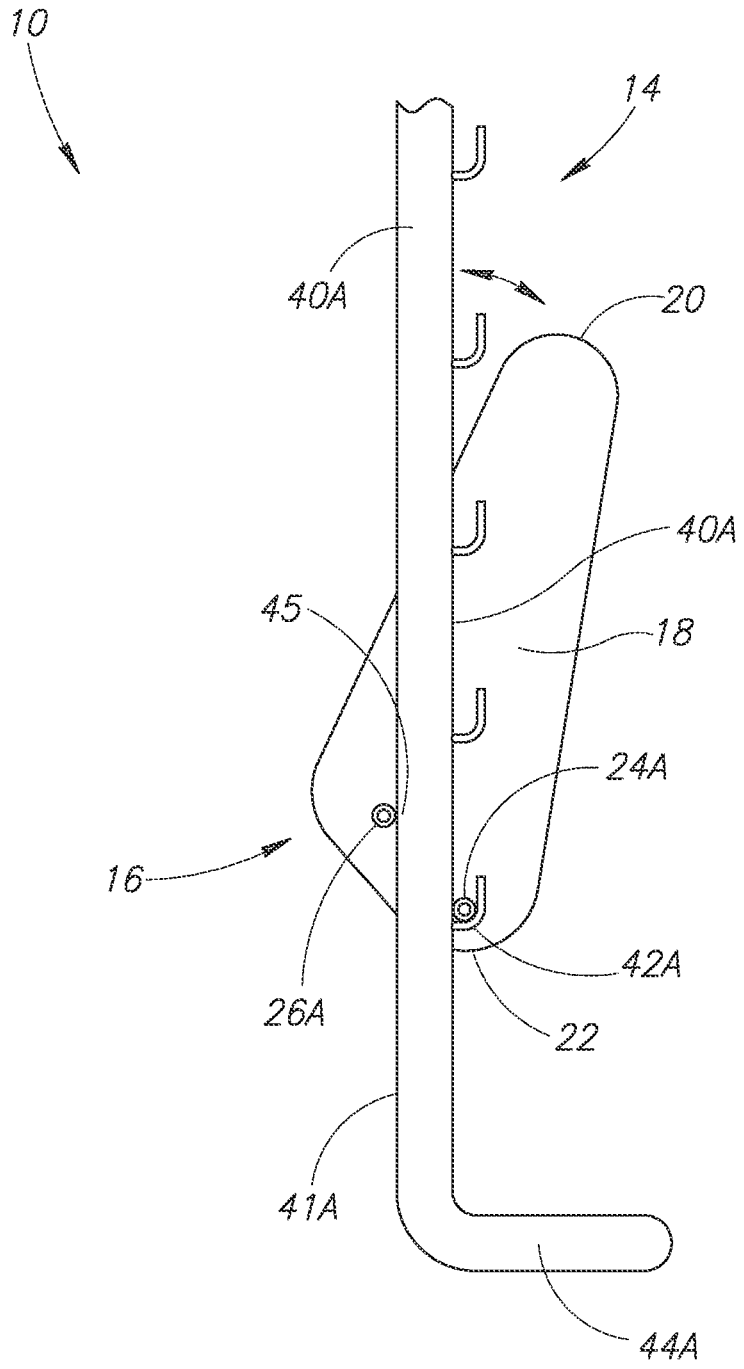
FIG. 4C is an enlarged right side elevational view of the foldable seat system shown when the seat is in the folded up position.

FIGS. 4A-4C are enlarged side elevational views of the seat system 10 and depict different positions of the foldable seat 16. In FIG. 4A, the seat 16 is shown folded fully down to allow a user to sit on the main body portion 18. In FIG. 4C, the seat 16 is shown fully folded up. FIG. 4B shows the seat 16 in a position midway between the positions shown in FIGS. 4A and 4C through which the seat would be folded when being folded up or down by a user. As shown in FIG. 4A, the stop rod 26A contacts the front surface 41A of the vertical bar 40A at a portion 43 below the hook 42A when the seat 16 is in the fully down position. As shown in FIG. 4C, the stop rod 26A contacts the front surface 41A at a portion 45 above the hook 42A when the seat 16 is in the folded up position. As shown in FIG. 4B (in dashed lines), the seat 16 can be easily moved upward and downward along the frame portion 14 to adjust the vertical position of the seat by raising the forward portion 20 until the horizontal distance between the stop rods 26A and 26B and the support rods 24A and 24B, respectively, is least as large as the horizontal distance between the front surface 41A and 41B of the vertical bars 40A and 40B and the rearward side of the vertically extending portion of the respective hooks 42A and 42B. The seat 16 can then be moved up or down for resting of the support rods 24A and 24B on the selected pair of hooks 42A and 42B.

During use, a user may easily hang the seat system 10 on the sidewall 105 of the hot tub 100 by simply grasping the frame portion 14 and positioning the hanger portion 60 over the edge 108 of the sidewall 105. When a user desires to remove the seat system 10 from the hot tub 100, the user may lift the frame portion 14 upward to disengage the hanger portion 60 from the sidewall 105.

As described above, the frame portion 14 of the seat system 10 simply hangs on the sidewall 105 of the hot tub 100. Thus, no mounting of any kind is required. This feature allows the seat system 10 to be moved freely around the periphery of the hot tub 100 so it can be placed in front of any of the jets, or removed completely. The pairs of hooks 42A and 42B on the rear of the vertical bars 40A and 40B are vertically spaced apart to provide a convenient height adjustment capability for the seat portion 16. Thus, the system 10 is completely functional with no mounting components and no real moving parts, nuts, or bolts.

Although the frame portion 14 is shown in the drawings has having a substantially circular cross-section, frames of other shapes (e.g., rectangular) may also be used. Further, the foldable hot tub seat system 10 may be formed from one or more suitable materials, including stainless steel, aluminum, plastic (e.g., PVC), or other materials appropriate for a hot tub environment. Generally, the material used may resist damage caused by corrosion, heat, and/or the sun.

Figure 6A:
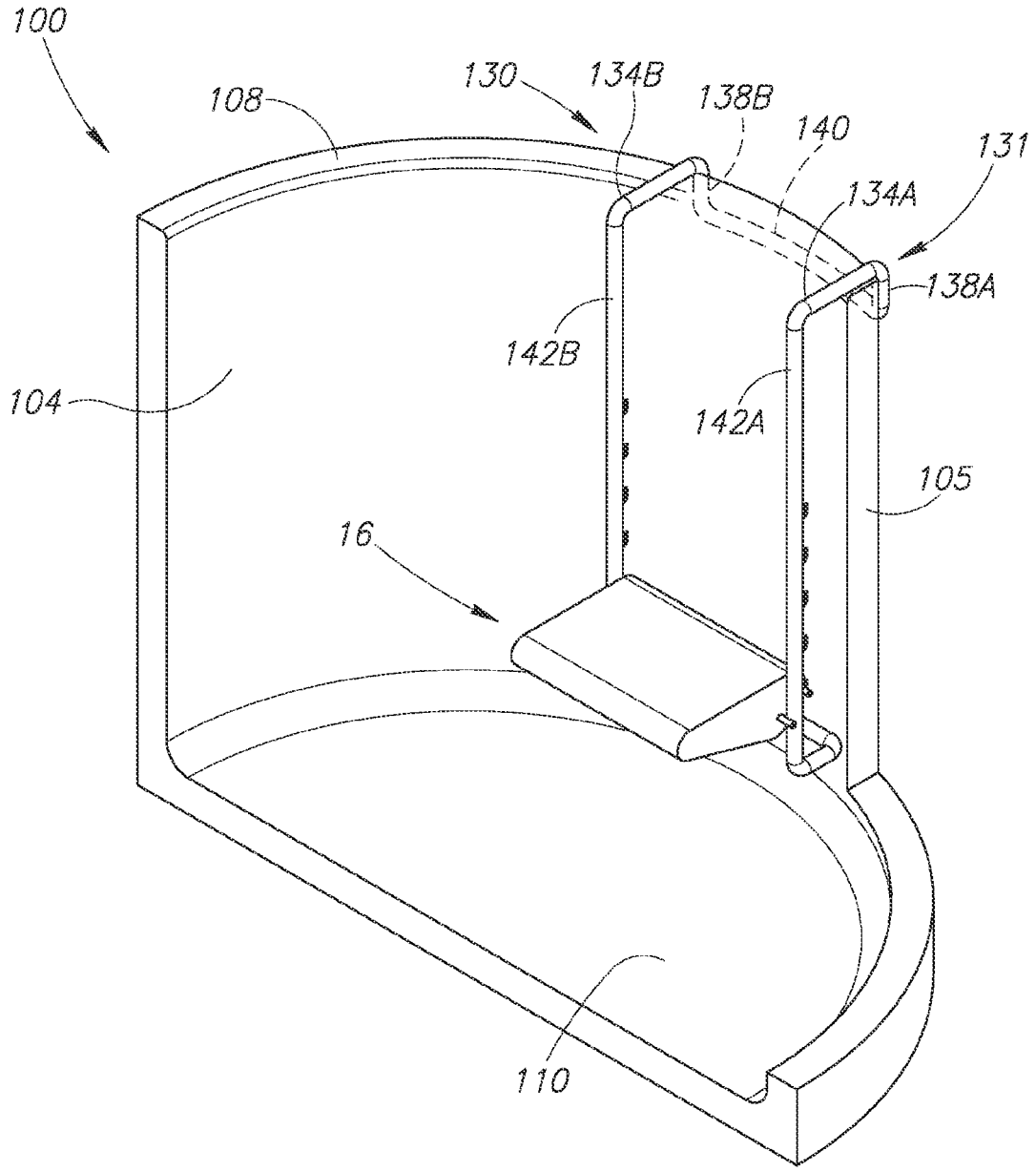
FIG. 6A is a front perspective view of a foldable seat system in accordance with another embodiment of the present invention releasably coupled to the hot tub shown when the seat is disposed in a fully down and unfolded position.
Figure 6B:
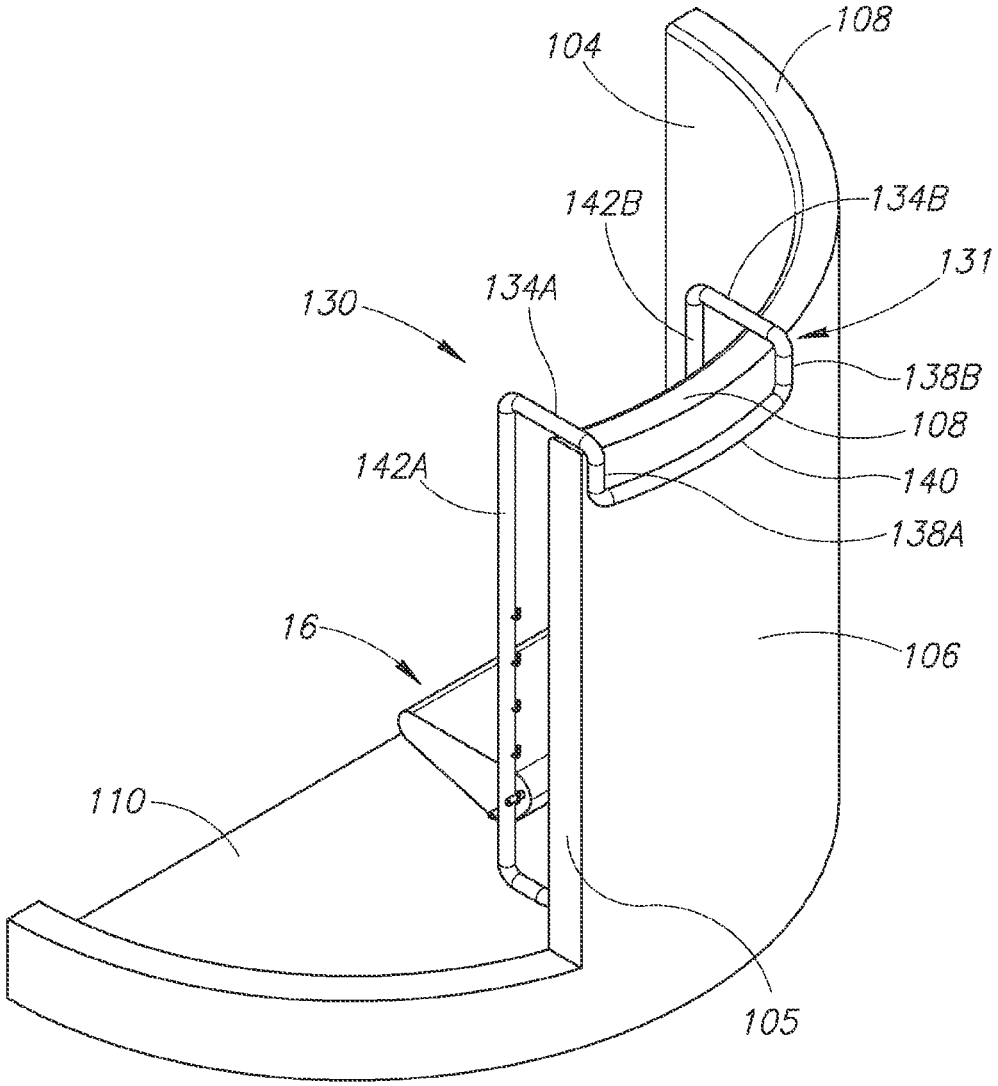
FIG. 6B is a rear perspective view of the foldable seat system shown in FIG. 6A.

FIGS. 6A and 6B illustrate another embodiment of a foldable hot tub seat system 130 shown hanging on the sidewall 105 of the hot tub 100. The hot tub seat system 130 is similar in many respects to the system 10 described above, so only differences between the two embodiments are described herein. The seat system 130 includes a hanger portion 131 comprising upper bars 134A and 134B extending horizontally backward from respective vertical bars 142A and 142B. The upper bars 134A and 134B are configured to rest on the upper edge 108 of the hot tub 100. The hanger portion 131 also includes vertical bars 138A and 138B extending downward from respective upper bars 134A and 134B adjacent the outside surface 106 of the sidewall 105. The vertical bars 138A and 138B are coupled together by a horizontal cross bar 140 that is shaped to substantially conform to the curvature of the outside surface 106 of the sidewall 105. In some embodiment, the bars 134A-B, 138A-B, 104, and 142A-B are integrally formed from a single material (e.g., stainless steel, etc.). Thus, similar to the system 10 discussed above, the seat system 130 is configured to hang on the top edge 108 of the sidewall 105 of the hot tub 100.

Figure 7A:
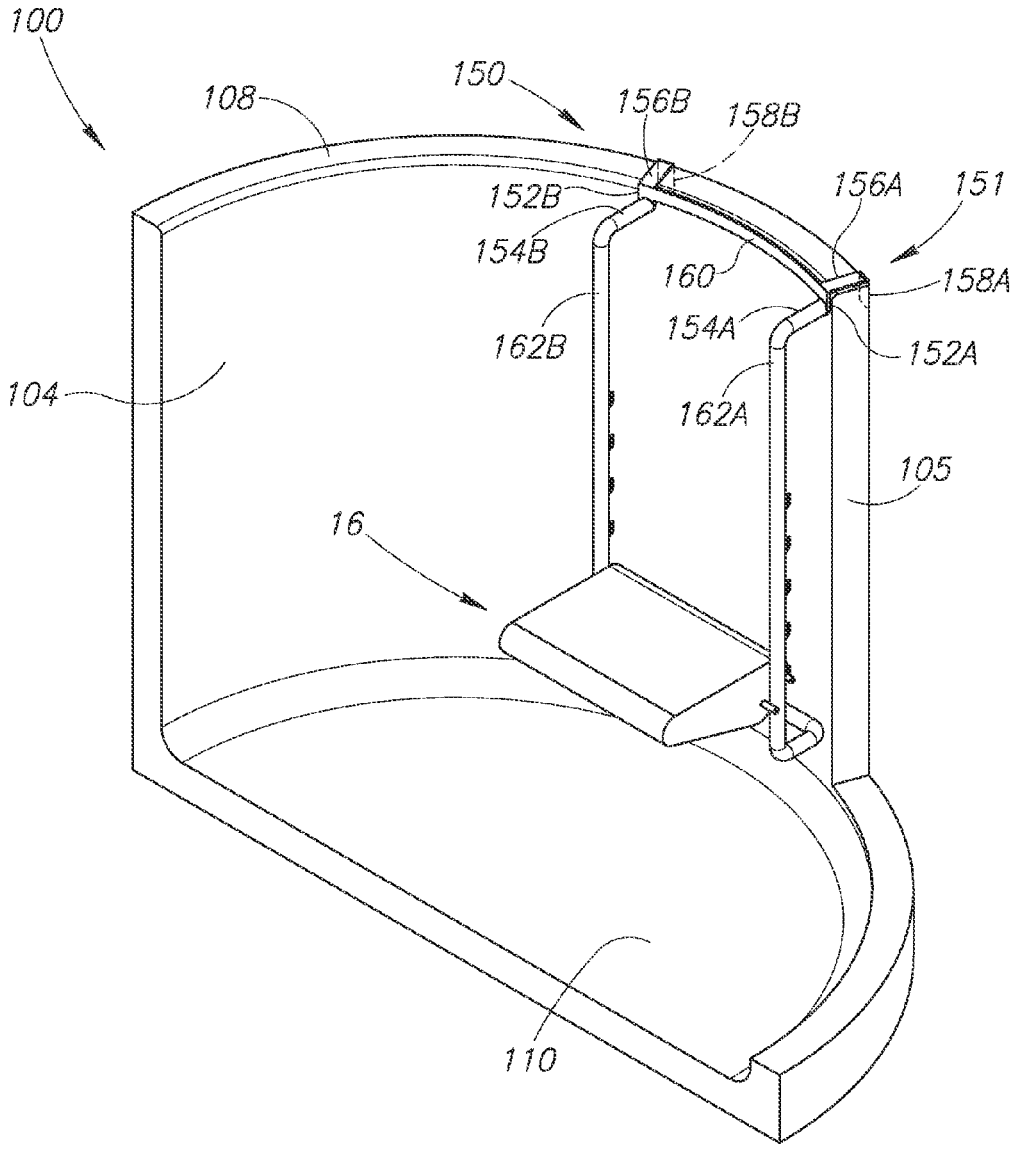
FIG. 7A is a front perspective view of a foldable seat system in accordance with another embodiment of the present invention releasably coupled to the hot tub shown when the seat is disposed in a fully down and unfolded position.
Figure 7B:
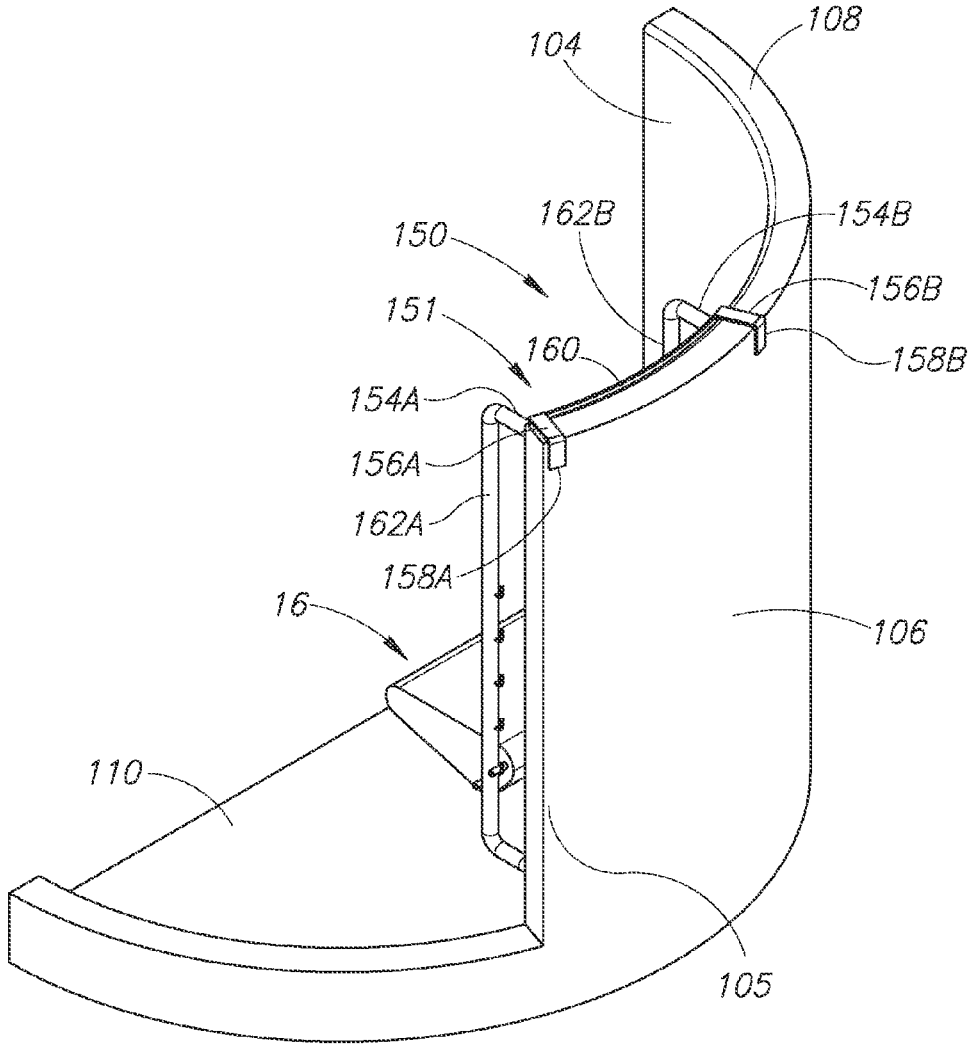
FIG. 7B is a rear perspective view of the foldable seat system shown in FIG. 7A.

FIGS. 7A and 7B illustrate another embodiment of a foldable hot tub seat system 150 shown hanging on the sidewall 105 of the hot tub 100. The hot tub seat system 150 is similar in many respects to the systems 10 and 130 described above, so only differences between the embodiments are described herein. The seat system 150 includes a hanger portion 151 comprising upper bars 154A and 154B extending horizontally backward from respective vertical bars 162A and 162B. The upper bars 154A and 154B are attached to right and left frame coupling portions 152A and 152B, respectively, of two u-shaped members. Each of the right and left frame coupling portions 152A and 152B is coupled to top portions 156A and 156B, respectively, that are configured to rest on the upper edge 108 of the hot tub 100. Each of the u-shaped members of the hanger portion 151 also includes vertical bars 158A and 158B extending downward from respective top portions 156A and 156B adjacent the outside surface 106 of the sidewall 105. The frame coupling portions 152A and 152B are coupled together by a horizontal cross bar 160 that is shaped to substantially conform to the curvature of the inside surface 104 of the sidewall 105. In some embodiments, the bars 154A-B, 158A-B, 150, and 152A-B may be integrally formed from a single material (e.g., stainless steel, aluminum, etc.). Thus, similar to the systems 10 and 130 discussed above, the seat system 150 is configured to hang on the top edge 108 of the sidewall 105 of the hot tub 100. It will be appreciated that other configurations for the hanger portions described herein may be used as well.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

What is claimed is:

1. A foldable seat system for use in a hot tub having a sidewall for confining water therein with a top edge, the seat system comprising:

a frame portion comprising:

a hanger portion configured for selective positioning over the top edge of the sidewall to releasably secure the frame portion to the hot tub;

a first vertical bar coupled to the hanger portion and extending downward therefrom, the first vertical bar comprising a first set of vertically spaced pin support members;

a second vertical bar coupled to the hanger portion and extending downward therefrom in a parallel, spaced-apart relationship with the first vertical bar, the second vertical bar comprising a second set of vertically spaced pin support members, each pin support member of the second set being disposed at the same height as a corresponding pin support member of the first set to form a pair of pin support members; and a seat portion comprising a body and a first support pin extending laterally outward therefrom on a first side and a second support pin extending laterally outward therefrom on a second side opposite the first side, the first support pin and the second support pin together being configured to rest on a pair of support pin support members, the seat portion being rotatable about an axis extending through the first and second support pins between a fully down position wherein a user may sit on the seat portion and a folded up position wherein the seat portion is folded up toward the sidewall of the hot tub.

2. The foldable seat system of claim 1, wherein the body of the seat portion further comprises a first stop pin extending laterally outward therefrom on the first side and a second stop pin extending laterally outward therefrom on the second side, the first and second stop pins being configured to engage the first and second vertical bars, respectively, to limit the rotation of the seat portion so that the seat portion is selectively maintained in the fully down position and the folded up position to which moved.

3. The foldable seat system of claim 1, wherein each of the pivot pin support members comprises an upwardly extending hook portion.

4. The foldable seat system of claim 1, wherein the first and second support pins are configured to rest on multiple different pairs of pin support members such that the height of the seat portion is selectively adjustable.

5. The foldable seat system of claim 1, wherein the frame portion further comprises a cross bar having a first end coupled to a lower portion of the first vertical bar and a second end coupled to a lower portion of the second vertical bar.

6. The foldable seat system of claim 1, wherein the hanger portion comprises a top plate shaped to complement the top edge of the sidewall, and a frame-retaining member extending downward from the top plate and configured to engage an outside surface of the sidewall when the hanger portion is positioned thereon.

7. The foldable seat system of claim 1, wherein the seat portion is adjustably movable on the frame portion by selectively rotating the seat portion and vertically moving the seat portion from one pair of pin support members to another pair of pin support members.

8. The foldable seat system of claim 1, wherein the frame portion is manufactured out of stainless steel material.

9. The foldable seat system of claim 1, wherein the frame portion is manufactured out of aluminum material.

10. The foldable seat system of claim 1, wherein the frame portion is manufactured out of plastic material.

11. A foldable seat system for use in a hot tub having a sidewall for confining water therein with a top edge, the seat system comprising:

a frame portion comprising:

a hanger portion configured for releasable engagement with the top edge of the sidewall; and a seat support portion coupled to the hanger portion and extending downward therefrom, the seat support portion including an upwardly extending hook portion; and a seat portion comprising a body and an engagement portion configured to engage the seat support portion, the seat portion being rotatable between a fully down position wherein a user may sit on the seat portion and a folded up position wherein the seat portion is folded up toward the sidewall of the hot tub.

12. The foldable seat system of claim 11, wherein the seat portion further comprises a stop portion configured to engage the frame portion to limit the rotation of the seat portion to maintain the seat portion in either the fully down position or the folded up position.

13. The foldable seat system of claim 11, wherein the seat support portion comprises multiple, vertically spaced-apart seat support portions such that the height of the seat portion is selectively vertically adjustable by engaging selectable ones of the seat support portion.

14. The foldable seat system of claim 11, wherein the seat portion is adjustably movable on the seat support portion by selectively vertically positioning of the seat portion relative to the seat support portion.

15. A foldable seat system for use in a hot tub having a sidewall for confining water therein with a top edge, the seat system comprising:

a frame portion comprising:

a hanger portion configured for releasable engagement with the top edge of the sidewall, the hanger portion including a top plate shaped to complement the top edge of the sidewall, and a frame-retaining member extending downward from the top plate configured to engage an outside surface of the sidewall when the hanger portion is positioned thereon; and a seat support portion coupled to the hanger portion and extending downward therefrom; and a seat portion comprising a body and an engagement portion configured to engage the seat support portion, the seat portion being rotatable between a fully down position wherein a user may sit on the seat portion and a folded up position wherein the seat portion is folded up toward the sidewall of the hot tub.

16. The foldable seat system of claim 15, wherein the frame portion is manufactured out of stainless steel material.

17. The foldable seat system of claim 15, wherein the frame portion is manufactured out of plastic material.

18. The foldable seat system of claim 15, wherein the frame portion is manufactured out of aluminum material.

19. The foldable seat system of claim 15, wherein the seat portion further comprises a stop portion configured to engage the frame portion to limit the rotation of the seat portion to maintain the seat portion in either the fully down position or the folded up position.

20. The foldable seat system of claim 15, wherein the seat support portion comprises multiple, vertically spaced-apart seat support portions such that the height of the seat portion is selectively vertically adjustable by engaging selectable ones of the seat support portion.

21. The foldable seat system of claim 15, wherein the seat portion is adjustably movable on the seat support portion by selectively vertically positioning of the seat portion relative to the seat support portion.

22. A foldable seat system for use in a hot tub having a sidewall for confining water therein with a top edge, the seat system comprising:

a frame portion comprising:

a hanger portion configured for releasable engagement with the top edge of the sidewall and comprising a top plate shaped to complement the top edge of the sidewall, and a frame-retaining member extending downward from the top plate configured to engage an outside surface of the sidewall;

a seat support portion coupled to the hanger portion and extending downward therefrom, the seat support portion comprising a pair of spaced apart hook portions; and a seat portion comprising a body and two support pins extending laterally outward from opposing sides that are each configured to rest on one of pair of the spaced apart hook portions of the seat support portion, the seat portion being rotatable between a fully down position wherein a user may sit on the seat portion and a folded up position wherein the seat portion is folded up toward the sidewall of the hot tub.

23. The foldable seat system of claim 22, wherein the seat portion further comprises a stop pin configured to engage the seat support portion to limit the rotation of the seat portion to maintain the seat portion in either the fully down position or the folded up position.

* * * * *